US006131639A

United States Patent [19]

McMillen et al.

[11] Patent Number: 6,131,639

[45] Date of Patent: Oct. 17, 2000

[54] OUTDOOR SCREEN ASSEMBLY

[76] Inventors: Linda R. McMillen; Charles L. McMillen, both of 9166 Jasmine Way, Fox River Grove, Ill. 60021

[21] Appl. No.: 09/344,054

[22] Filed: Jun. 25, 1999

[51] Int. Cl.[7] ..... A47H 1/00

[52] U.S. Cl. ..... 160/123; 160/349.1

[58] Field of Search ..... 160/123, 126, 160/330, 124, 332, 349.1, 368.1, 354, 327, 349.2

[56] References Cited

U.S. PATENT DOCUMENTS

| | | | |
|---|---|---|---|
| 2,245,285 | 6/1941 | Loeb | 160/330 X |
| 3,455,366 | 7/1969 | Bogumil . | |
| 3,777,800 | 12/1973 | Susoev | 160/330 X |
| 4,100,957 | 7/1978 | Shelton . | |
| 4,142,570 | 3/1979 | Heimberg | 160/349.1 |
| 4,188,991 | 2/1980 | Boyle | 160/124 |
| 4,437,505 | 3/1984 | Rodgers | 160/126 |
| 4,761,945 | 8/1988 | Bunger | 160/349.1 X |
| 4,874,028 | 10/1989 | Lynch et al. | 160/126 X |
| 5,048,587 | 9/1991 | York . | |
| 5,205,337 | 4/1993 | Bozzo | 160/330 X |
| 5,323,835 | 6/1994 | Bachmeier . | |
| 5,358,025 | 10/1994 | Wood . | |
| 5,427,169 | 6/1995 | Saulters . | |
| 5,524,689 | 6/1996 | Clark | 160/126 X |

*Primary Examiner*—David M. Purol
*Attorney, Agent, or Firm*—Kenneth L Tolar

[57] ABSTRACT

A screen assembly includes first and second substantially rectangular panels each mounted in ajuxtaposed fashion over a doorway. The inner edges of each panel include an elongated chain along the entire length thereof. The lower edge of each panel includes a plurality of weights to prevent the panels from flapping and to maintain the panels in a vertical position within the doorway. The design allows a user to pass between the inner edges after which the screen panels will automatically return to their original positions. Accordingly, users may repeatedly pass through the screen assembly without having to open a screen door.

6 Claims, 1 Drawing Sheet

OUTDOOR SCREEN ASSEMBLY

BACKGROUND OF THE INVENTION

The present invention relates to a uniquely designed screen assembly that allows a user to walk through a doorway without sliding the screen to one side.

DESCRIPTION OF THE PRIOR ART

Screen doors are often mounted on exterior doorways allowing a user to enjoy fresh air while preventing insects and other pests from entering the building. However, conventional screen doors are hinged and pivot open similarly to the conventional door or include a frame that slides on a track. Opening the conventional screen doors is burdensome especially for the elderly. The conventional devices are particularly troublesome when a homeowner is cooking outdoors, hosting an outdoor party or has children where several people are repeatedly entering and exiting the building. With each entry or exit, the user must slide the door to an open position and then to a closed position which is annoying. Often, the screen is not completely closed thereby allowing unwanted pests or animals to enter. Furthermore, pet owners often need a means for allowing a pet to enter and exit the house at will. The present invention overcomes the above enumerated disadvantages associated with the prior art by providing a screen assembly through which users may readily walk without having to slide or open a door. Once the user has passed through the screen assembly, it automatically returns to its original, closed configuration.

Various screen assemblies exist in the prior art. For example, U.S. Pat. No. 5,427,169 issued to Saulters relates to a flexible garage door screen.

U.S. Pat. No. 5,358,025 issued to Wood relates to a fabric garage enclosure.

U.S. Pat. No. 5,323,835 issued to Bachmeier relates to a removable screen for a car garage door.

U.S. Pat. No. 5,048,587 issued to York relates to a portable screen door insert.

U.S. Pat. No. 4,100,957 issued to Shelton relates to a screen for side and rear door openings of vans and like vehicles.

U.S. Pat. No. 3,455,366 issued to Bogumil relates to a quick demountable screen for enclosing garage doorways and the like.

Although various screen assemblies exist in the prior art, none relate to a pair of screen panels attached to a door frame allowing a user to easily walk through the screen without having to open a door.

SUMMARY OF THE INVENTION

The present invention relates to a screen assembly including a pair of substantially rectangular screen panels each having an upper edge, a lower edge, an inner edge and an outer edge. Each panel includes hook and loop fasteners on one side adjacent the upper and outer edges thereof for attaching the panel to a door frame. Disposed along the entire length of the inner edge of each panel is an elongated chain. The lower edge of each panel includes a plurality of pockets each having a weight received therein to maintain the panels in a substantially horizontal position. The panels are attached to the doorframe such that the inner edges are disposed immediately adjacent each other. The assembly allows a user to walk between the adjacent panels, after which time the chain and weights will cause the panels to return to their original positions. It is therefore an object of the present invention to provide a screen assembly that may be quickly and easily installed.

It is another object of the present invention to provide a screen assembly that allows a user to walk therethrough. Other objects, features and advantages of the present invention will become readily apparent from the following detailed description of the preferred embodiment when considered with the attached drawings and the appended claims.

DESCRIPTION OF THE PREFERRED EMBODIMENT

Figure 2:
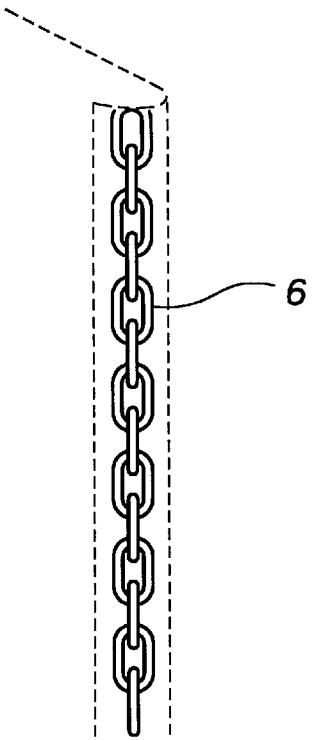
FIG. 2 is a detailed view of the side mounted chains.
Figure 3:
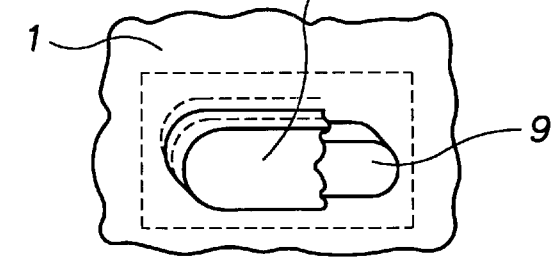
FIG. 3 is a detailed view of a pocket with a weight received therein.
Figure 1:
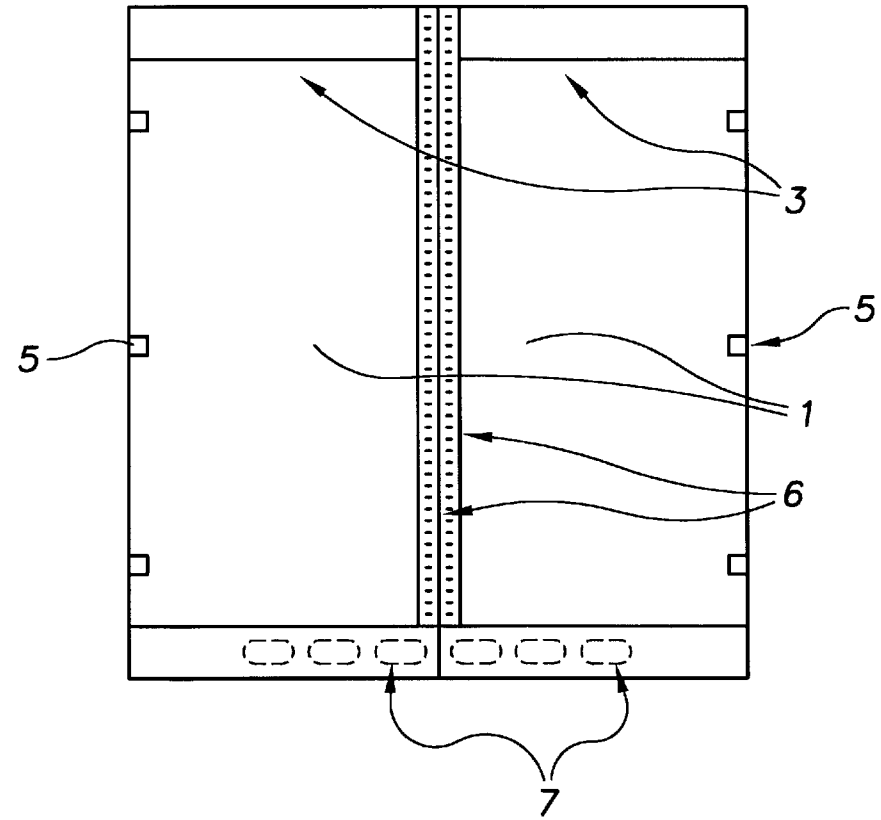
FIG. 1 depicts the screen assembly in an installed position.

Referring now to FIGS. 1 through 3, the present invention relates to a screen assembly for covering a doorway that allows a user to walk therethrough. The assembly includes a pair of substantially rectangular screen panels 1 each having a top edge, a bottom edge, an outer edge, an inner edge, an inwardly facing side and an outwardly facing side. Disposed on the inwardly facing side of each panel along the entire length of the top edge is a strip 3 of hook and loop fasteners for engaging a mating strip on the top border of a doorway.

Likewise, on the inwardly facing side of each panel, adjacent a side edge, are a plurality of hook and loop patches 5 for engaging similar patches on a side border of the doorway. Each of the inner edges include an elongated weighted structural member 6, such as a chain, along the entire length thereof that is sewn into or otherwise integral with the panel. The chains provide structural integrity to the inner edges and assure that, when the screens are mounted, each inner edge abuts the other inner edge along its entire length to form a unitary screen cover with no gaps or openings.

The lower edge of each panel includes a plurality of pockets 7 each having a weight 9 received therein that maintains each panel in a substantially horizontal position. The weights also prevent the lower edges of the panels from flapping or bending.

The panels are mounted over the opening normally covered by the door. The outer and top edges of a first panel are attached to a side border and a portion of the top border of the doorway respectively. The outer and top edges of the second panel are mounted to the remaining portion of the top border and the other side border of the doorway. The panels are mounted with their inner edges immediately adjacent and abutting each other as depicted in FIG. 1.

To use the screen assembly, the door is left open whereby the screen assembly will cover the entire doorway and will prevent insects and similar pests from entering the room. If a user or pet wishes to exit or enter the room, he or she may simply walk between the inner edges of the panels after which time the panels will automatically return to their original configuration.

Preferably, the screen panels are constructed with a mesh material that is rigid but somewhat pliable to allow the device to fumction as described above. The panels may be dimensioned and configured to fit within any size doorway.

In addition, the size, shape and materials of construction of the above described components may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A screen assembly for a doorway comprising:

a pair of screen panels, each having an inwardly facing side with an attachment means thereon for attaching said panels to a doorway border to cover said doorway, each of said panels including an inner edge, an outer edge, a top edge and a lower edge, said panels mounted with the inner edges abutting each other, said inner edges forming a means for passing through said screen assembly;

a chain disposed along substantially the entire length of the inner edge of each panel to assure that, after a user passes between said inner edges, said inner edges return to an original position.

2. A screen assembly according to claim 1 wherein each of said panels include a weight means disposed adjacent the lower edge thereof to maintain said panels in a substantially planar, vertical position.

3. A screen assembly according to claim 2 wherein said weight means comprises:

plurality of pockets adjacent the lower edge of each panel;

a weight received within each pocket.

4. A screen assembly according to claim 3 wherein said attachment means is a hook and loop fastener.

5. A screen assembly according to claim 4 wherein said hook and loop fasteners are disposed along substantially the entire length of the top edge of each panel for securing the top edge of each panel to a top border of a doorway.

6. A screen assembly according to claim 5 wherein said hook and loop fasteners are disposed along the outer edges of each side panel to secure each outer side edge to a side border of a doorway.

* * * * *